United States Patent [19]

Bernard et al.

[11] Patent Number: 4,986,203

[45] Date of Patent: Jan. 22, 1991

[54] METHOD FOR RAISING ANY OBJECT LYING ON THE BOTTOM OF THE SEA, A RIVER OR BASIN, AND APPARATUS USED THEREBY

[75] Inventors: Alain Bernard, Heistraat; Marc Stordiau, Antwerp, both of Belgium

[73] Assignee: Hydro Soil Services, Dessel, Belgium

[21] Appl. No.: 435,778

[22] Filed: Nov. 13, 1989

[30] Foreign Application Priority Data

Dec. 17, 1986 [BE] Belgium ..... 217549

[51] Int. Cl.[5] ..... B63C 7/08

[52] U.S. Cl. ..... 114/51

[58] Field of Search ..... 114/44, 50, 51, 55, 114/221 A, 221 R, 222; 405/132, 138, 145, 146

[56] References Cited

U.S. PATENT DOCUMENTS

| | | | |
|---|---|---|---|
| 710,869 | 10/1902 | Johnson et al. | 114/51 |
| 747,102 | 12/1903 | Vance et al. | 114/51 |
| 1,005,408 | 10/1911 | Brown | 114/51 |
| 1,616,410 | 2/1927 | Buell | 114/51 |
| 1,776,210 | 9/1930 | Wortmann | 114/51 |
| 1,961,591 | 6/1934 | McArdle et al. | 114/51 |
| 4,499,840 | 2/1985 | Lung-Tung | 114/51 |

*Primary Examiner*—Sherman Basinger
*Assistant Examiner*—Stephen P. Avila
*Attorney, Agent, or Firm*—Scully, Scott, Murphy & Presser

[57] ABSTRACT

Method and apparatus for raising an object from a sea, river or basin bottom. A lifting platform is arranged adjacent the object to be raised, from the platform supporting tubes are arranged at an angle relative to the bottom from 10° to 90° to lay a connection between the lifting platform and the bottom, and boring rods are inserted through the supporting tubes, whereby use is made for boring of a boring device which does not require rotating the boring rods proper, the boring device being bent at such an angle that the boring rods connected thereto are moved along a curve underneath the object to be raised, the boring is then continued until the boring device, having the boring rods connected thereto, projects far enough out of the bottom, and finally use is made of the obtained bore to lead a cable from one to the other side of the object to be raised.

6 Claims, 4 Drawing Sheets

METHOD FOR RAISING ANY OBJECT LYING ON THE BOTTOM OF THE SEA, A RIVER OR BASIN, AND APPARATUS USED THEREBY

BACKGROUND OF THE INVENTION

1. Field of the Invention

This invention relates to a method for raising a sunken ship, and generally any object lying on the bottom of the sea, a river or a basin.

2. Discussion of the Prior Art

To allow for raising sunken ships, wrecks or other objects which lie on the bottom of a basin, for example a sea or river bottom, by means of jigs, pontoons or other floating equipment with hoisting apparatus, it is generally required to arrange hoisting slings, cables, chains or similar devices underneath the wreck. The wreck secured in this way to hoisting cables may then be raised out of the water by means of the required hoisting appliances.

A technically-impracticable method for raising wrecks is disclosed in German Patent No. 828,068. According to this method and by means of the device provided therefor, it is proposed to drive strongly-curved tubes from an underwater-dwelling apparatus, underneath the wreck and to pull a cable through said tubes.

First of all, operating from an underwater-dwelling apparatus, which has to insure propulsing said curved tubes, is a very inconvenient and in actual practice under many conditions, an impracticable assignment.

Secondly, it is necessary to work with strongly-curved tubes; and due to the previously-selected curvature radius of said tubes, it is always necessary to bore to some depth when a required width or distance is to be obtained. With wide wrecks, it will also be required to bore more deeply, which makes adapting the boring depth to the geological conditions impossible.

SUMMARY OF THE INVENTION

It is therefore an object of the invention to provide a method and an apparatus which brings an original solution to the problems encountered in the prior art and completely do away with the disadvantages pertaining to the above-described techniques.

For this purpose, a lifting platform or pontoon is arranged adjacent the object to be raised, from said lifting platform or pontoon supporting tubes are arranged at an angle from 10° to 90° to lay the connection between the lifting platform or pontoon and the bottom and boring rods are inserted through said supporting tubes, whereby use is made for boring of a means which does not require rotating the boring rods themselves and said means is bent at such an angle that said boring rods connected thereto are moved along a curve underneath the object to be raised. The boring is then continued until said means with the connecting boring rods projects far enough out of the bottom, and finally use is made of the obtained bore to lead a cable from the one side to the other side of said object.

The invention further pertains to an apparatus for working the method according to the invention.

BRIEF DESCRIPTION OF THE DRAWINGS

Other details and advantages of the invention will stand out from the following description of a method for raising a sunken ship and the apparatus used thereby, given by way of non limitative example and with reference to the accompanying drawings, in which.

DETAILED DESCRIPTION OF THE PREFERRED EMBODIMENT

Figure 1:
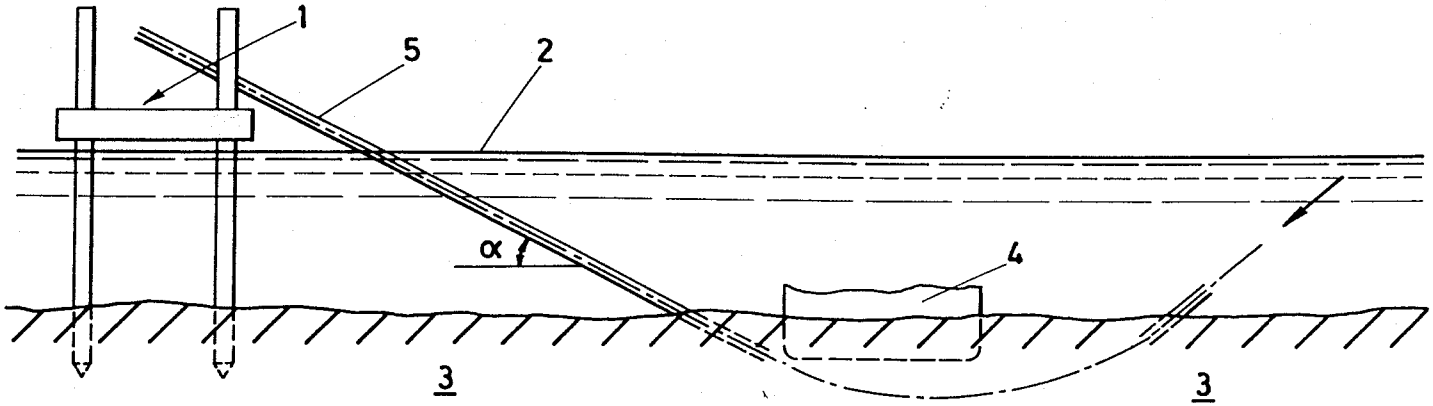
FIG. 1 is a diagrammatic showing of the method for raising a sunken object according to the invention.

FIG. 1 which makes the method diagrammatically clear, shows a lifting platform under general reference numeral 1, the sea level 2 and the sea bottom 3. A sunken ship, wreck or object is shown diagrammatically at 4.

From the lifting platform 1, there are first laid supporting tubes 5 with the purpose of obtaining under the most advantageous angle 0, the connection between the lifting platform 1 and bottom 3, adjacent to the wreck 4. The angle in FIG. 1 is arbitrary but lies very advantageously in the range from 10° to 15°, although angles approaching 90° may be considered.

Boring rods are led through the supporting tubes 5. The boring rods are actually comprised of inner boring rods 6 on which the boring means are mounted, and of outer boring rods 7.

The boring rods being used are straight boring rods with a relatively small diameter. The inner boring rods have an outer diameter between about 1" and 3", while the outer boring rods, also known in the trade as "washover pipes", have an outer diameter between about 2" and 5". The boring rods are hollow. On the first inner boring rod 6 there is located the boring crown 8 which is driven by a boring motor 9. The boring motor 9 may also be replaced by other boring means which will be mentioned hereinafter.

According to the invention, it is possible from said lifting platform 1, to make an arched boring with a small curvature radius from 25 to 100 m, which means that the curvature underneath the sunken object may be considered as large.

Figure 2:
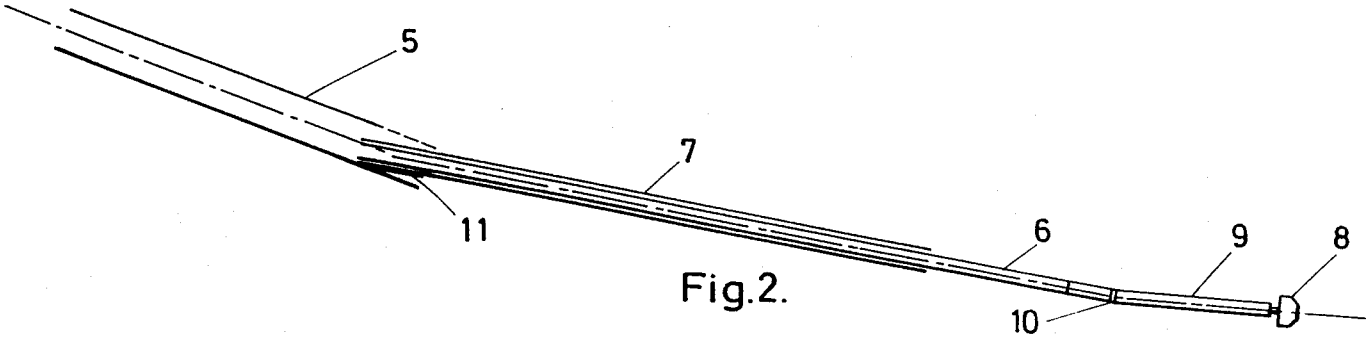
FIG. 2 is a diagrammatic showing which makes clear a detail from the method and apparatus according to the invention.
Figure 3:
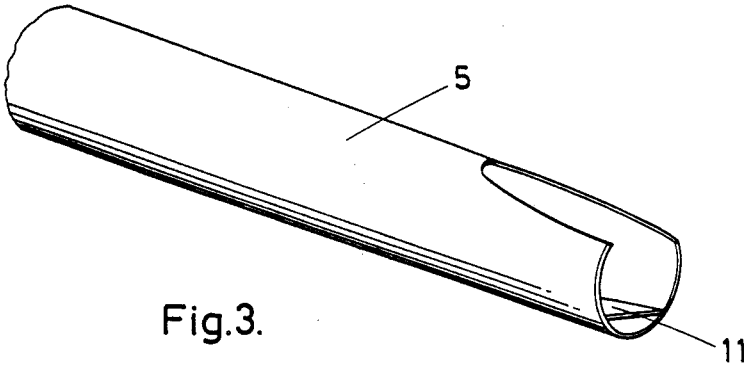
FIG. 3 is a perspective showing on a larger scale of a possible variation of a detail of the preferred embodiment.
Figure 4:
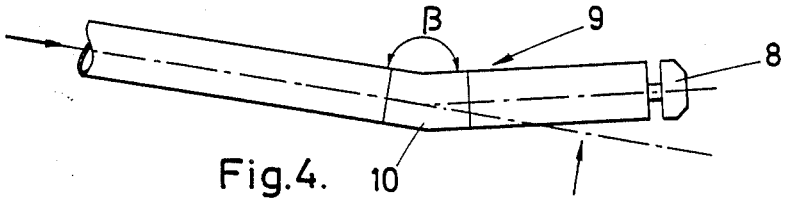
FIG. 4 shows on another scale and in a side view, the curved part pertaining to or following the boring motor.

To allow for making the arched boring underneath the object lying on the bottom, through the sea bottom, a bend part 10 is provided in or directly after said boring motor 9, whereby the required bend is obtained. Such bend is very clearly visible in FIGS. 2 and 4.

The angle of bend part 10 is determined as a function of the local conditions and is at least 0.5°. Even if the drawing does not show it, said bend part may be so remotely controlled that the boring direction may be changed during the boring operation.

Figure 5:
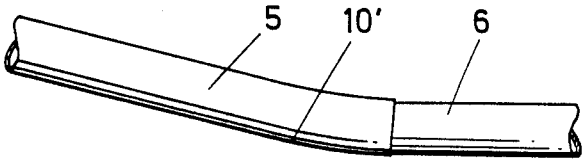
FIG. 5 shows on another scale, a possible variation in the method whereby the supporting tubes are provided with a curve adjacent the end thereof.

To induce the necessary arc-like bend when starting boring, that is when the boring head projects out of the supporting tubes, a deflecting plate 11 may be arranged on the end of said supporting tubes 5. In a possible variation, the supporting tubes 5 may in turn be bent under the required angle adjacent that end thereof bearing on the bottom. The location where such bending is noticeable, is shown at 10' in FIG. 5. When the first boring rod with boring head is moved along the deflecting plate along the supporting tube lengthwise axis, that angle whereunder the arc-like boring will occur is underneath the sunken object 4.

Figure 6:
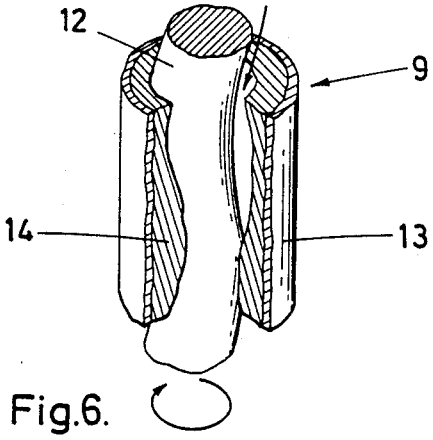
FIG. 6 shows diagrammatically, with parts broken away, a possible embodiment of the boring motor.

The boring may be performed by means of a boring crown 8 driven by a boring motor 9, which is driven by a rotor which is moved in turn by the boring liquid which flows under high pressure inside the boring rods. Such a boring motor may for example be of that type known under the name "moineau" which FIG. 6 pertains to. Such a motor is comprised of a rotor 12 with stator 13, which is lined inwardly with a rubber casing 14 the crosswise and lengthwise profile of which makes possible the desired revolution of rotor 12. It is indeed clear that the boring rods, at least the inner boring rods 6, can not revolve due to the presence of said bend part 10 which makes such resolving of the boring rods, at least of the inner boring rods 6, impossible.

Figure 7:
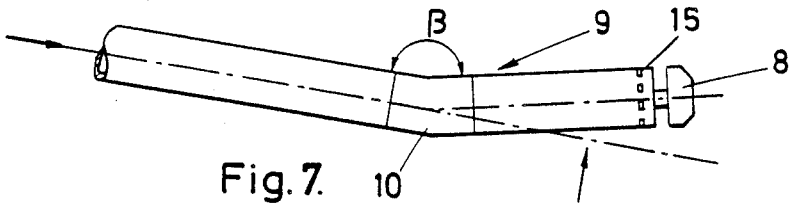
FIG. 7 shows an alternate embodiment of the boring crown.
Figure 8:
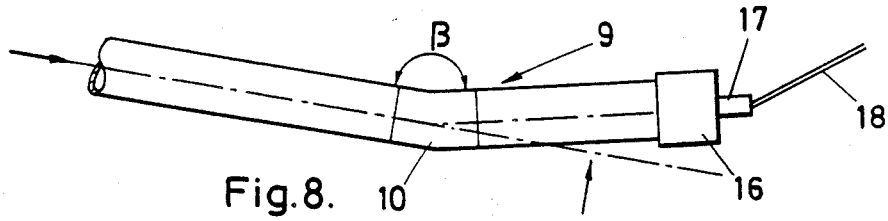
FIG. 8 shows a cable connection for hoisting after completion of the boring operation.
Figure 9:
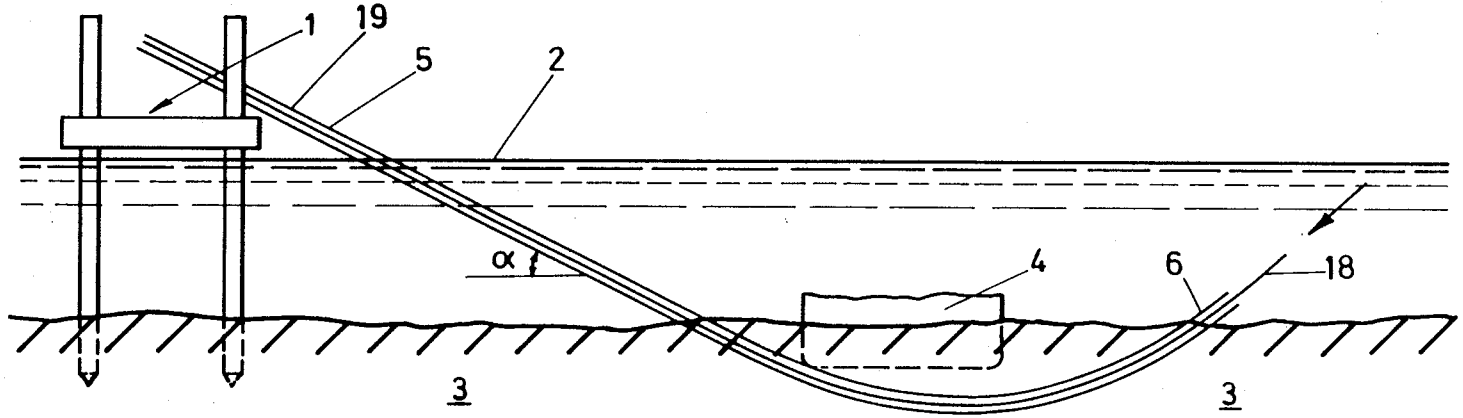
FIG. 9 shows the cable inside the bore during the hoisting operation.

As shown in FIG. 7, it is also possible to bore with a boring unit comprised of a tube-like head with holes 15 wherethrough the boring liquid may be sprayed under high pressure to loosen the ground.

On the lifting platform 1, besides the required boring equipment, a high-pressure pump is arranged which allows pumping through the inner boring rods 6 a boring liquid, for example bentonite flushing, water, foam, etc., under a very high pressure up to 75 bars to the boring head.

As already made clear hereinabove, the boring rods are of straight shape but with a relatively small diameter, which lets the rods adapt easily to the bore curving. The outer boring rods 7 are to be used optionally according to the underground composition. When the friction on the inner boring rods is too high, so-called "washover pipes" are positioned over the inner boring rods 6 to partly remove the friction. These outer boring rods 7 follow the curving of the inner boring rods 6. Boring liquid is pumped into the space between the inner boring rods 6 and outer boring rods 7.

On the boring rod end, that is inside boring motor 9, a possibility is provided to measure and monitor the boring head position. The purpose thereof is clear. At every moment the accurate boring head position (x, y, z coordinates, or depth, azimuth and direction, or one of these parameters) can be determined and measured with specific accuracy. By means of the information being obtained, the boring head position may then be compared to the planned bore path and the boring device may be adjusted and steered. Means for this purpose are not considered as being part of the invention and may be part of what is known in the trade as "single shot" or "multiple shot" system, magnetic sensing systems, etc.

When the boring head with the boring rods connected thereto, has come out of the bottom past the sunken ship, use may then be made of at least two embodiments for bringing a hoisting cable through the arched bore underneath the sunken object 4.

First of all, a diver can uncouple the boring crown from the boring motor 9 and couple to said boring motor a connecting sleeve 16 with hook 17 for a cable 18. Pulling back the boring rods, thus also the boring motor, with hoisting cable, may then occur from the lifting platform. The required hoisting cable then remains inside the arched bore for the further raising or salvage operations.

Secondly, the diver can burn off a boring rod directly behind the boring motor and recover said boring motor. From the lifting platform, a thin cable 19 (for example 10 mm) may be "pumped" through the inner boring rods 6. A forerunner with a thickness of 24 mm for example, may be fastened to said thin cable. Forerunner and thin cable are pulled through the inner boring rods from a work ship. The inner boring rods are then pulled back through the supporting tubes from the lifting platform. The hoisting cable remains inside the arched bore for the further salvage operations.

From the above-described method for raising a sunken ship, a wreck or an object lying on the bottom of the sea, a river or a basin, and from the pertaining apparatus described by way of example, the advantages of this original salvage method stand out clearly. According to the size of the sunken ship or the wreck or object to be raised, various similar borings are made from the lifting platform, and with the required pontoons and floating hoisting apparatus, the salvage of ship, wreck or object can occur.

It must be understood that the invention is in no way limited to the above embodiments and that many changes may be brought thereto without departing from the invention scope.

What is claimed is:

1. Method for raising a sunken ship, and generally any object lying on the bottom of the sea, a river or a basin, comprising arranging a lifting platform adjacent the object to be raised, from said lifting platform supporting tubes are arranged in relation to the sea bottom at an angle from 10° to 90° to lay a connection between the lifting platform and the bottom, and inserting boring rods through said supporting tubes, whereby use is made of a means for boring connected to said boring rods which does not require rotating the boring rods proper and said boring means is bent at such an angle that said boring rods connected thereto are moved along a curve underneath the object to be raised, continuing boring until said boring means, with the boring rods connected thereto projects far enough out of the bottom, and finally use is made of the obtained bore to lead a cable from one side to another side of said object, wherein said boring means comprises a boring motor having a boring crown which revolves inside said boring rods due to a boring liquid being pumped through said boring rods, and wherein said boring crown is uncoupled and replaced by a sleeve and hook for a hoisting cable, said boring rods and boring motor with said hoisting cable are pulled back so that said cable remains inside said bore.

2. Method as defined in claim 1, in which said boring means connected to the boring rod, is comprised of a tube with holes wherethrough boring liquid can be pumped under high pressure.

3. Apparatus for raising a sunken ship, wreck or an object lying on the bottom of a body of water, which is comprised mainly of one or more of the following components implemented from a lifting platform:

(a) a first set of tubes for laying a connection between the lifting platform and the bottom;

(b) boring rods comprising inner and outer boring rods which are movable through said tubes and which extend outside said tubes at an end opposite said lifting platform;

(c) a boring means mounted on said boring rods at said end opposite said platform;

(d) a boring means comprising a boring motor with a bend part; and (e) a second set of tubes which are bent adjacent the end opposite said platform bearing on the bottom, wherein an end of said first set of tubes is provided with an inwardly projecting deflecting plate to induce an arc-like boring path for said inner boring rods.

4. Apparatus as defined in claim 3, in which said boring means are comprised of a boring motor fitted with a rotor and boring crown, which is revolved by liquid being pumped through the inner boring rods.

5. Apparatus as defined in claim 4, in which said boring means are comprised of a tube mounted on the end of said inner boring rods, with holes wherethrough boring liquid can be sprayed under high pressure for loosening the bottom.

6. Method for raising a sunken ship, and generally any object lying on the bottom of the sea, a river or a basin, comprising arranging a lifting platform adjacent the object to be raised, from said lifting platform supporting tubes are arranged in relation to the sea bottom at an angle from 10° to 90° to lay a connection between the lifting platform and the bottom, and inserting boring rods through said support tubes, whereby use is made of a means for boring connected to said boring rods which does not require rotating the boring rods proper and said boring means is bent at such an angle that said boring rods connected thereto are moved along a curve underneath the object to be raised, continuing boring until said boring means, with the boring rods connected thereto projects far enough out of the bottom, and finally use is made of the obtained bore to lead a cable from one side to another side of said object, wherein said boring means comprises a boring motor having a boring crown which revolves inside said boring rods due to a boring liquid being pumped through said boring rods, and wherein the boring rod lying behind said boring motor is burned off, whereafter a first cable is passed from the lifting platform through said supporting tubes and said boring rods for connection to a hoisting cable.

* * * * *